US007004796B2

(12) United States Patent
Fukuda et al.

(10) Patent No.: US 7,004,796 B2
(45) Date of Patent: Feb. 28, 2006

(54) WIRING HARNESS, AND WIRING HARNESS MANUFACTURING METHOD

(75) Inventors: Masaru Fukuda, Haibara-gun (JP); Takeya Miwa, Haibara-gun (JP); Shinji Mochizuki, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 9 days.

(21) Appl. No.: 10/479,603

(22) PCT Filed: Jun. 3, 2002

(86) PCT No.: PCT/JP02/05428

§ 371 (c)(1),
(2), (4) Date: Jul. 14, 2004

(87) PCT Pub. No.: WO02/099931

PCT Pub. Date: Dec. 12, 2002

(65) Prior Publication Data

US 2004/0242068 A1 Dec. 2, 2004

(30) Foreign Application Priority Data

Jun. 4, 2001 (JP) ..... 2001-168474

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS

| | | | | |
|---|---|---|---|---|
| 6,027,374 | A * | 2/2000 | Nagai et al. | 439/596 |
| 6,146,200 | A * | 11/2000 | Ito et al. | 439/596 |
| 6,244,901 | B1 * | 6/2001 | Fujii et al. | 439/596 |
| 6,273,755 | B1 * | 8/2001 | Yamamoto | 439/596 |
| 6,485,333 | B1 * | 11/2002 | Shinchi | 439/587 |
| 6,761,589 | B1 * | 7/2004 | Venditti et al. | 439/596 |
| 6,780,070 | B1 * | 8/2004 | Ishikawa et al. | 439/752 |
| 2004/0077230 | A1 * | 4/2004 | Nakano | 439/752 |

FOREIGN PATENT DOCUMENTS

| | | |
|---|---|---|
| EP | 0 696 085 A2 | 2/1996 |
| JP | 11-185841 A | 7/1999 |
| JP | 2000-231959 A | 8/2000 |
| WO | WO 95/20252 A2 | 7/1995 |

* cited by examiner

*Primary Examiner*—Hung V. Ngo
(74) *Attorney, Agent, or Firm*—Sughrue Mion, PLLC

(57) ABSTRACT

There are provided a wire harness and a method of manufacturing the wire harness capable of reducing the assembling cost. The wire harness includes: an insulating housing (3), on the board (11) of which partition walls (12) are arranged in parallel with each other; a cover member (2) capable of holding the insulating housing (3); a large number of pressure-connecting terminals (15) and crimping terminals (16) respectively arranged along the partition walls (12); and a large number of electric wires (103) respectively connected to the pressure-connecting terminals (15) and crimping terminals (16). The wire harness is formed by conducting the manufacturing steps of: a pressure-connecting terminal inserting step in which the pressure-connecting terminals (15) are arranged between the partition walls (12); a pressure-connecting step in which the electric wires (103) are connected with the pressure-connecting terminals (15); a crimping step in which the crimping terminals (16) are arranged between the partition walls (12) after the electric wires are connected with the crimping terminals (16); and a cutting step in which the material insulating housing (13) is cut into a predetermined length, wherein these steps are conducted in an arbitrary order, and the wire harness is formed by further conducting the manufacturing step of: a connector assembling step in which the insulating housing (3) is held by the cover member (2).

6 Claims, 14 Drawing Sheets

WIRING HARNESS, AND WIRING HARNESS MANUFACTURING METHOD

TECHNICAL FIELD

The present invention relates to a wire harness. For example, the present invention relates to a wire harness preferably used for electrically connecting control equipment and electronic equipment which are mounted on a vehicle.

BACKGROUND ART

Conventionally, passenger's vehicles and other various types of vehicles have been automatized. According to the automatization of the vehicles, various control equipment and electronic equipment such as CPU are mounted on the vehicles.

These control equipment and electronic equipment are electrically connected by a wire harness so that electric power can be supplied to the equipment and further control signals to control the equipment can be communicated by the equipment.

The wire harness 100 shown in FIG. 14 is essentially composed in such a manner that various types of connectors such as a male type connector 101 and a female type connector 102 are connected with each other by a plurality of electric wires 103 and bundled with the tape 104 and the like.

The type and number of the connectors, the type and number of the electric wires 103 and the branch positions of the wire harness are freely changed, for example, according to the wiring position in a vehicle. Further, the bundling method is not limited to the tape 104. Depending upon the number of the electric wires 103, the electric wires 103 are inserted into the tube 105 for bundling. Alternatively, the electric wires 103 are bound by cords at predetermined intervals. In the case where the adjoining connectors are connected with each other or the electric wires are grounded at a position close to the connector, the electric wires are not bundled as shown by reference numeral 103*a* in some cases. In this case, the ground terminal 106 for grounding is crimped at the end portion of the electric wires.

In the case of laying the wire harness 100 in a vehicle, the connectors 101, 102 are engaged and connected with the connector terminals provided in the electronic equipment or the connectors provided in the other wire harness. The ground terminal 106 is screwed and fixed to a vehicle body or the like.

Portions of the wire harness bundled by the tape 104 are fixed to portions of the vehicle body with appropriate engaging members, so that the connectors can be prevented from being disconnected when vibration is given to the connectors while the vehicle is driving and further vibration of the entire wire harness 100 can be prevented.

As a result, even when the vehicle is used in a severe environment, disconnection of the connectors and breaking of the electric wires can be prevented.

In this connection, the connectors 101, 102 are composed in such a manner that terminals connected with electric wires are inserted into a housing made of synthetic resin. The connector terminals are composed of a conductive metal sheet formed into an appropriate shape. According to the form of connecting the electric wires, the connector terminals are classified into a pressure-connecting terminal and a crimping terminal.

In the pressure-connecting terminal, pressure-connecting blades used for connecting the electric wires are arranged being opposed to each other on the inner side faces of an electric wire connecting portion, the lateral cross section of which is formed into a U-shape. In the case of connecting the electric wire, the electric wire covered with the sheath is press-fitted into between the pressure-connecting blades.

As a result, the pressure-connecting blades cut the sheath of the electric wire and come into contact with the core wire. Therefore, the electric wire and the pressure-connecting terminal are connected with each other capable of being electrically connected.

On the other hand, in the case of the crimping terminal, both wall portions of the electric wire connecting portion can be bent. The lateral cross section of the electric wire connecting portion is formed into a U-shape. In the case of connecting the electric wire, the sheath is stripped off from the electric wire so as to expose the core wire. Next, the core wire is positioned in the electric wire connecting portion, and then both wall portions are bent so that the core wire can be crimped.

As a result, the core wire and the crimping terminal are connected with each other capable of being electrically connected.

Incidentally, the wire harness 100 is shown in the drawing and explained simply as a wire 103, however, the wire harness 100 actually includes various electric wires, that is, electric wires of large diameters and electric wires of small diameters are used together with each other according to the amount of an electric current flowing in the electric wire. Further, a twist wire is used for the wire harness 100. Furthermore, a shielded wire is jointly used in the wire harness 100 for the high frequency circuit such as an antenna circuit and for the circuit to control fuel injection so that noise generated in the circuit can be reduced.

As described above, it is a fact that various electric wires are provided in the actual wire harness 100 being mixed with each other. When these various electric wires are connected with the pressure-connecting terminals and the crimping terminal, the following advantages and disadvantages are provided.

First, the advantages of the pressure-connecting terminal are described as follows. Since the pressure-connecting terminal is composed in such a manner that the pressure-connecting terminal is contacted with the core wire when the blades cut into the sheath of the electric wire. Therefore, the connecting work is simple, and this pressure-connecting terminal is suitably used for automatization. However, disadvantageous of the pressure-connecting terminal are as follows. When the diameter of the electric wire is small with respect to the interval of the pressure-connecting blades which are arranged being opposed to each other, it is impossible to connect the electric wire with the pressure-connecting terminal. Further, in the case of an electric wire of a large diameter, the diameter of the electric wire to be connected with the pressure-connecting terminal is limited. Furthermore, the pressure-connecting terminal can not be applied to a shielded wire. It is difficult for the pressure-connecting terminal to be connected with a twist wire.

On the other hand, advantageous of the crimping terminal is as follows. The crimping terminal is composed so that the core wire of the electric wire can be crimped for connection. Therefore, not only the shielded wire and twist wire but also the electric wires of different diameters can be connected. Further, since the connection can be conducted by crimping, the connecting strength is high.

However, disadvantageous of the crimping terminal is as follows. In the case of the crimping terminal, it is necessary to strip the sheath from the electric wire so as to expose the core wire. In addition to the manual work conducted for crimping, this stripping work for stripping the sheath from the electric wire deteriorates the working property, which raises the production cost.

Incidentally, JP-A-2000-231959 discloses "Method of Manufacturing Pressure-connecting terminal". According to the method of manufacturing a pressure-connecting terminal, electric wires are pressure-connected with the pressure-connecting terminals arranged in parallel in a band-shaped insulating carrier so that the insulating carrier having the electric wires can be composed. This insulating carrier having the electric wires is cut into pieces, the number of which is the required number of poles, and accommodated in a case so that the pressure-connecting terminal can be composed.

According to the above constitution, the pressure-connecting connectors, the number of which is the same as the number of the required poles, can be simply and quickly obtained. When the crimping terminals can be applied to the thus disclosed pressure-connecting connector, this connector can be used for multiple objects.

By the way, as explained referring to FIG. 14, the pressure-connecting terminals and the crimping terminals are arranged in the actual wire harness 100 being mixed with each other.

When the pressure-connecting terminals and the crimping terminals are arranged being mixed with each other, it becomes difficult to automatize the assembling process of assembling the connectors 101, 102. Accordingly, it is difficult to reduce the cost of manufacturing the wire harness.

DISCLOSURE OF THE INVENTION

The present invention has been accomplished to solve the above problems. It is an object of the present invention to provide a wire harness, the manufacturing cost of which can be reduced It is another object of the present invention to provide a method of manufacturing the wire harness.

In order to accomplish the above objects, the present invention described in claim 1 provides a wire harness including: an insulating housing having a substantially band-shaped board, on which partition walls continuously formed in the width direction of the board are arranged at regular intervals in the longitudinal direction of the board, the insulating housing capable of being cut by a predetermined length; a cover member capable of holding the insulating housing; a large number of pressure-connecting terminals and crimping terminals respectively arranged along the partition walls; and a large number of electric wires respectively connected with the pressure-connecting terminals and crimping terminals, wherein the wire harness is formed by conducting the manufacturing steps of: a pressure-connecting terminal inserting step in which the pressure-connecting terminals are respectively arranged between the partition walls; a pressure-connecting step in which the electric wires are respectively connected with the pressure-connecting terminals; a crimping step in which the crimping terminals are respectively arranged between the partition walls after the electric wires are respectively connected with the crimping terminals; and a cutting step in which the insulating housing is cut into a predetermined length, wherein these steps are conducted in an arbitrary order, the wire harness is formed by further conducting the manufacturing step of a connector assembling step in which the housing is held by the cover member.

In the wire harness composed as described above, concerning the connectors composing the wire harness, the step in which the pressure-connecting terminals are inserted into the insulating housing to connect the electric wires with pressure and the step relating to the crimping terminals are separate from each other. Therefore, a ratio of automatization in the process of assembling can be enhanced.

As described in claim 2, in the wire harness of the present invention, the electric wire connected with the crimping terminal is either a revolving wire, flexible electric wire, thick electric wire, twist electric wire or shielded electric wire laid between a pair of connectors directed in the same direction along the longitudinal direction of the wire harness.

In this case, the flexible wire is defined as an electric wire having core wires, the diameters of which are less or equal to 0.3 mm, the number of which is not less than 8, which are laid, for example, in the periphery of a door of a vehicle.

The thick electric wire is an electric wire having core wires, the diameters of which are not less than 0.5 mm, the number of which is not less than 17, in which a relatively high intensity of electric current flows.

The twist wire is an electric wire, the core wire of which are covered with a metallic braid, which is provided on the sheath layer, via an insulating layer. The twist wire is mainly used as a signal conductor.

On the other hand, the present invention provides method of manufacturing a wire harness, the wire harness including: a connector having an insulating housing having a substantially band-shaped board, on which partition walls continuously formed in the width direction of the board are arranged at regular intervals in the longitudinal direction of the board, the insulating housing capable of being cut by a predetermined length, the connector also having a cover member capable of holding the insulating housing; a large number of pressure-connecting terminals and crimping terminals respectively arranged along the partition walls; and a large number of electric wires respectively connected with the pressure-connecting terminals and crimping terminals.

As described in claim 3 of the present invention, the method of manufacturing a wire harness comprises: a pressure-connecting terminal inserting step in which the pressure-connecting terminals are respectively arranged between the partition walls; and then a pressure-connecting step in which the electric wires are respectively connected with the pressure-connecting terminals; and then a cutting step in which the insulating housing is cut into a predetermined length; a crimping step in which the crimping terminals are respectively arranged between the partition walls after the electric wires are connected with the crimping terminals; and then a connector assembling step in which the housing is accommodated by the cover member.

In the method of manufacturing a wire harness described above, in the connector assembling step, the pressure-connecting terminals are inserted into the insulating housing, into which various terminals are inserted, without cutting the insulating housing. Next, the electric wires are connected and then the housing is cut by a predetermined length. Then, the process shifts to the assembling step relating to the crimping terminals. Therefore, it is possible to maintain a feeding speed of the insulating housing to be constant, which is suitable for automatization.

As described in claim 4 of the present invention, the method of manufacturing a wire harness comprises: a cutting step in which the insulating housing is cut into a predetermined length; and then a pressure-connecting terminal inserting step in which the pressure-connecting terminals are arranged between the partition walls; and then a pressure-connecting step in which the electric wires are connected with the pressure-connecting terminals; and then a crimping step in which the crimping terminals are arranged between the partition walls after the electric wires are connected with the crimping terminals; and then a connector assembling step in which the housing is accommodated in the cover member.

In the method of manufacturing a wire harness described above, the insulating housing into which various terminals are inserted is cut by a predetermined length. The pressure-connecting terminals are inserted into the thus cut insulating housing and connected with electric wires. Next, the process shifts to a step relating to the crimping terminals which is a different step.

Accordingly, there is no possibility of the occurrence of an accident in which electric wires are mistakenly cut off in the case of cutting the insulating housing. Therefore, the percent defective can be decreased. Since a predetermined necessary quantity of the insulating housing is cut off from the long band-shaped insulating housing, it is possible to avoid waste, and the residual portion of the insulating housing is conveyed to the other step, that is, the residual portion of the insulating housing can be effectively used.

As described in claim 5 of the present invention, the method of manufacturing a wire harness comprises: a pressure-connecting terminal inserting step in which the pressure-connecting terminals are arranged between the partition walls; and then a cutting step in which the insulating housing is cut into a predetermined length; and then a pressure-connecting step in which the electric wires are connected with the pressure-connecting terminals; and then a crimping step in which the crimping terminals are arranged between the partition walls after the electric wires are connected with the crimping terminals; and then a connector assembling step in which the housing is accommodated in the cover member.

In the method of manufacturing a wire harness described above, the pressure-connecting terminals are inserted into the insulating housing, and the insulating housing is cut by a predetermined length. Then, electric wires are connected with the pressure-connecting terminals. Next, the process shifts to a step relating to the crimping terminal which is a different step.

Accordingly, the effect of reducing a possibility that the electric wires are cut off and the effect of being capable of conveying the residual portion of the insulating housing, which is generated in the process of cutting the insulating housing by a predetermined length, can be made to be compatible with each other at a high-order dimension.

As described in claim 6 of the present invention, in the method of manufacturing a wire harness, the pressure-connecting terminal is a female pressure-connecting terminal having a pair of elastic pieces, and a substantially box-shaped protective portion to surround the elastic pieces is omitted.

In the method of manufacturing a wire harness described above, the pressure-connecting terminals are accommodated in the terminal accommodating portions of the partition walls formed in the insulating housing. Therefore, a pair of elastic pieces can be protected, so that the structure of the terminal can be simplified.

Figure 1:
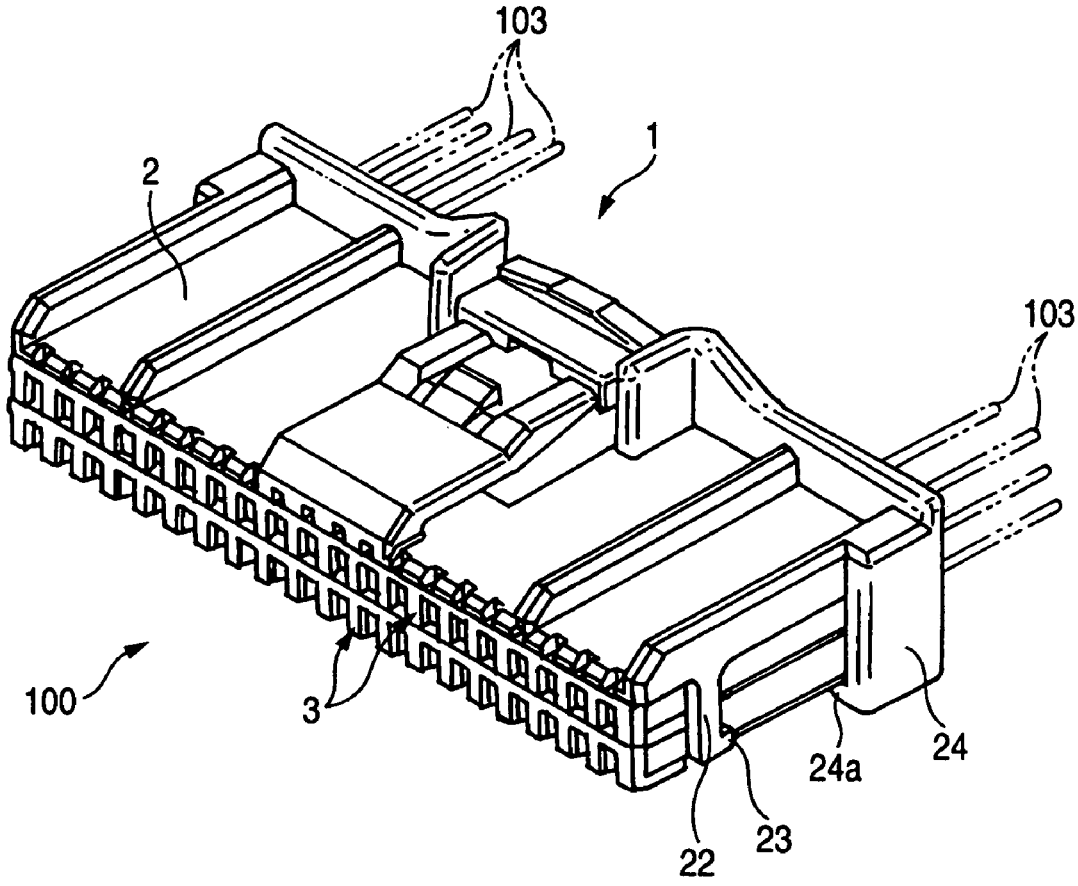
FIG. 1 is a perspective view showing a connector composing a wire harness according to the first embodiment of the present invention.

In this connection, in the drawings, reference numeral 1 is a connector, reference numeral 2 is a cover member, reference numerals 3 and 13 are insulating housings, reference numeral 11 is a board, reference numeral 12 is a partition wall, reference numeral 15 is a pressure-connecting terminal, reference numeral 16 is a crimping terminal, reference numeral 17 is a terminal accommodating portion, and reference numeral 100 is a wire harness.

BEST MODE FOR CARRYING OUT THE INVENTION

Referring to the drawings, embodiments of the present invention will be explained in detail as follows. In this connection, like reference characters are used to indicate like parts in the explanations of the following embodiments so as to simplify or omit the explanations.

Figure 2:
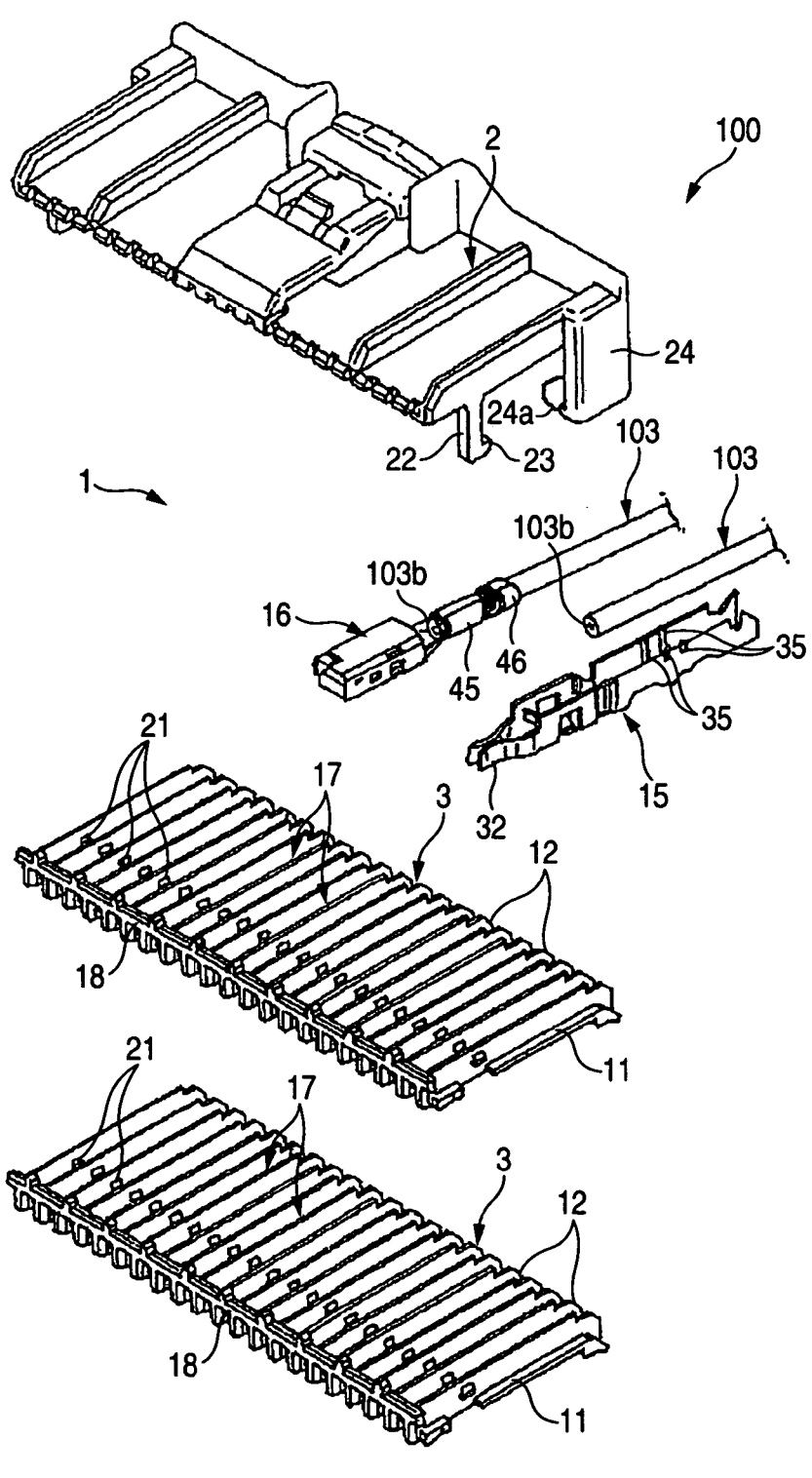
FIG. 2 is an exploded perspective view showing a connector of the first embodiment.

As shown in FIGS. 1 and 2, the wire harness 100 according to the first embodiment of the present invention includes a connector 1 for accommodating a plurality of pressure-connecting terminals 15 and crimping terminals 16 which are respectively connected with a large number of electric wires 103.

The connector 1 includes insulating housings 3, 3 in which the pressure-connecting terminals 15 or crimping terminals 16 can be individually arranged and a cover member 2 capable of holding the insulating housings 3, 3.

Figure 3:
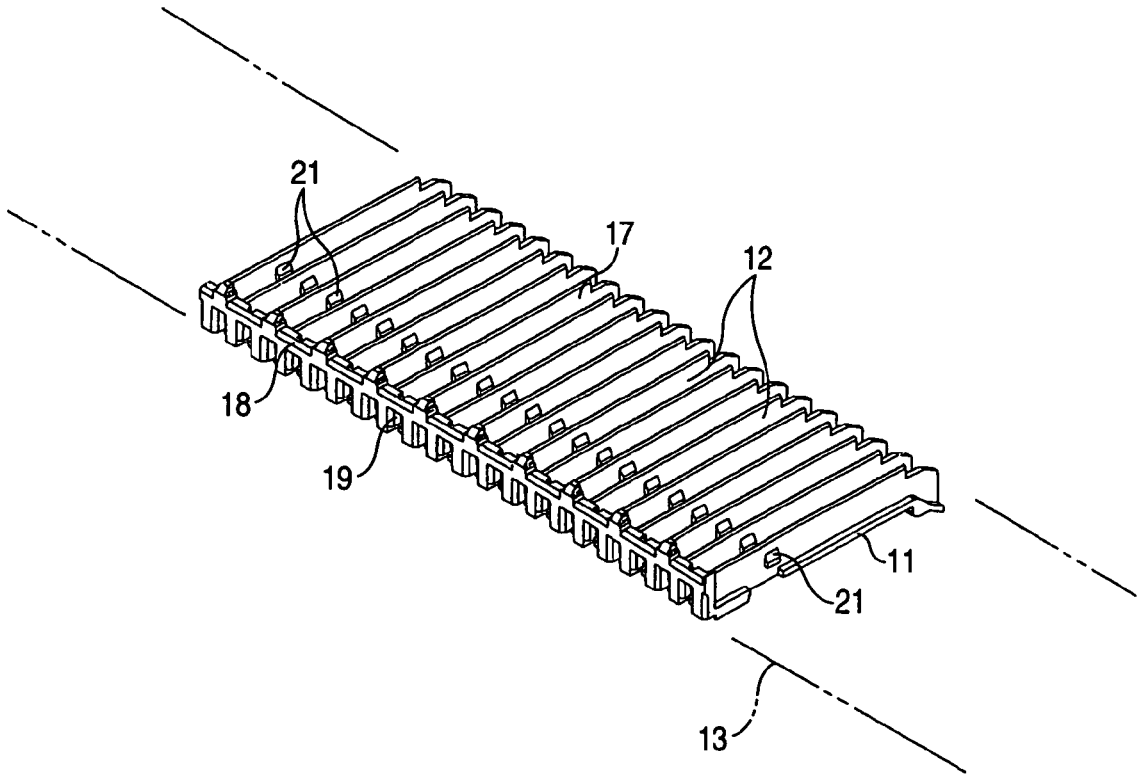
FIG. 3 is a perspective view showing an insulating housing.

As shown in FIG. 3, the insulating housing 3 has partition walls 12 which are continuously arranged on the substantially band-shaped board 11 in the width direction of the board 11 at regular intervals. Spaces formed between the partition walls 12 are formed into the terminal accommodating portions 17 in which the pressure-connecting terminals 15 and the crimping terminals 16 are inserted.

The terminal accommodating portion 17 has an erection member 18 which is arranged on one end side of the board 11 in the width direction (on the left of FIG. 3). The other end side of the board 11 in the width direction is open. The erection member 18 continues in the longitudinal direction of the insulating housing 3 and has insertion ports 19 into which male terminals (not shown) connected with the pressure-connecting terminals 15 or the crimping terminals 16 are inserted. Each insertion port 19 is communicated with each terminal accommodating portion 17 passing through the erection member 18.

In this insulating housing 3, the engaging protrusions 21 are formed on both sides of each partition wall 12. The engaging protrusions 21 prevent the pressure-connecting terminal 15 or the crimping terminal 16, which is inserted into the terminal accommodating portion 17, from coming out. In order for the pressure-connecting terminal 15 or the crimping terminal 16 to be easily inserted, each engaging protrusion 21 has an oblique face which is formed being tapered in a direction separating from the board 11.

As shown by chain lines in FIG. 3, when the material insulating housing 13, in which a large number of terminal accommodating portions 17 are arranged, for example, 50 terminal accommodating portions 17 are arranged, is cut by a predetermined length, for example, 20 terminal accommodating portions 17 are formed in this insulating housing 3.

Accordingly, one side of the partition wall 12 and one side of the engaging protrusion 21 are exposed to both end portions in the longitudinal direction of the insulating housing 3, and the terminal accommodating portion 17 and the insertion port 19, which are respectively split into a half, appear.

These insulating housings 3, 3 are put on each other in the thickness direction of the boards 11, 11.

Referring again to FIGS. 1 and 2, the cover member 2 is formed into a substantially rectangular shape so that the upper insulating housing 3 in the insulating housings 3, 3, which are put on each other, can be covered with the cover member 2. The cover member 2 includes a plate-shaped guide member 24 which extends from the end edge of the short side of the cover member 2 to the insulating housing 3 on the lower side and an engaging member 22.

In this cover member 2, the short side end edge of the board 11 of the insulating housing 3 on the lower side is guided in the width direction by the guide pawl 24*a* provided at the forward end of the guide member 24, and the engaging pawl 23 provided at the forward end of the engaging member 22 engages with the engaging protrusion 21 exposed in the insulating housing 3 on the lower side.

Due to the above structure, the insulating housings 3, 3 are integrated into one body so that they can not come out from the cover member 2.

Figure 4:
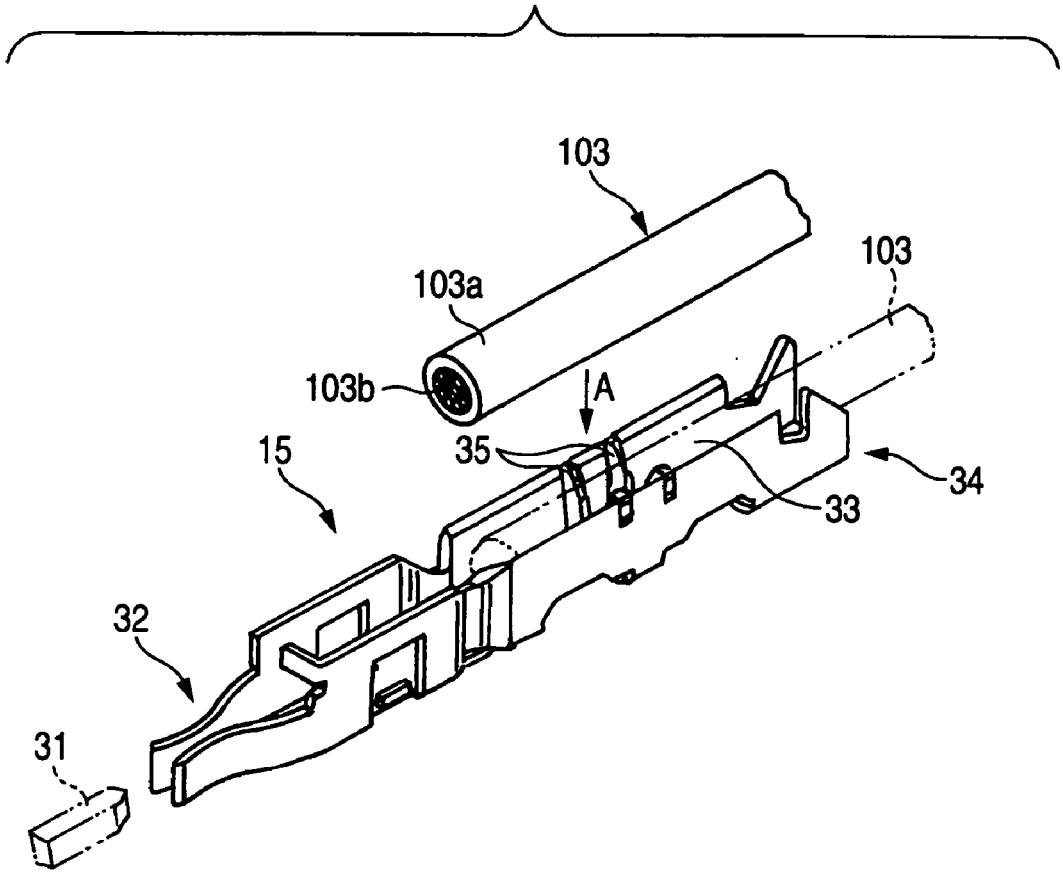
FIG. 4 is a perspective view showing a pressure-connecting terminal.

As shown in FIG. 4, the pressure-connecting terminal 15 is a female terminal formed by press-forming a metal sheet. The pressure-connecting terminal 15 includes a connecting portion 32 elastically coming into contact with the male terminal 31 of the opponent connector, an electric wire connecting portion 33 for connecting the electric wire 103, and an electric wire fixing portion 34 for integrally crimping the electric wire 103 with the sheath 103*a*. The electric wire connecting portion 33 includes four pressure-connecting blades 35 which are arranged inside being opposed to each other. A substantially box-shaped protective portion surrounding the connecting portion 32 is omitted in this structure.

In the case where the electric wire 103 is connected with this pressure-connecting terminal 15, the electric wire 103 is press-fitted into the electric wire connecting portion 33 from an upper portion of the electric wire connecting portion 33 as shown by arrow A in the drawing. As a result, the pressure-connecting blade 35 of the pressure-connecting terminal 15 cuts into the sheath 103*a* of the electric wire 103 and comes into contact with the core wire 103*b*, so that the electric wire 103 and the pressure-connecting terminal 15 can be connected with each other being electrically communicated.

Figure 5:
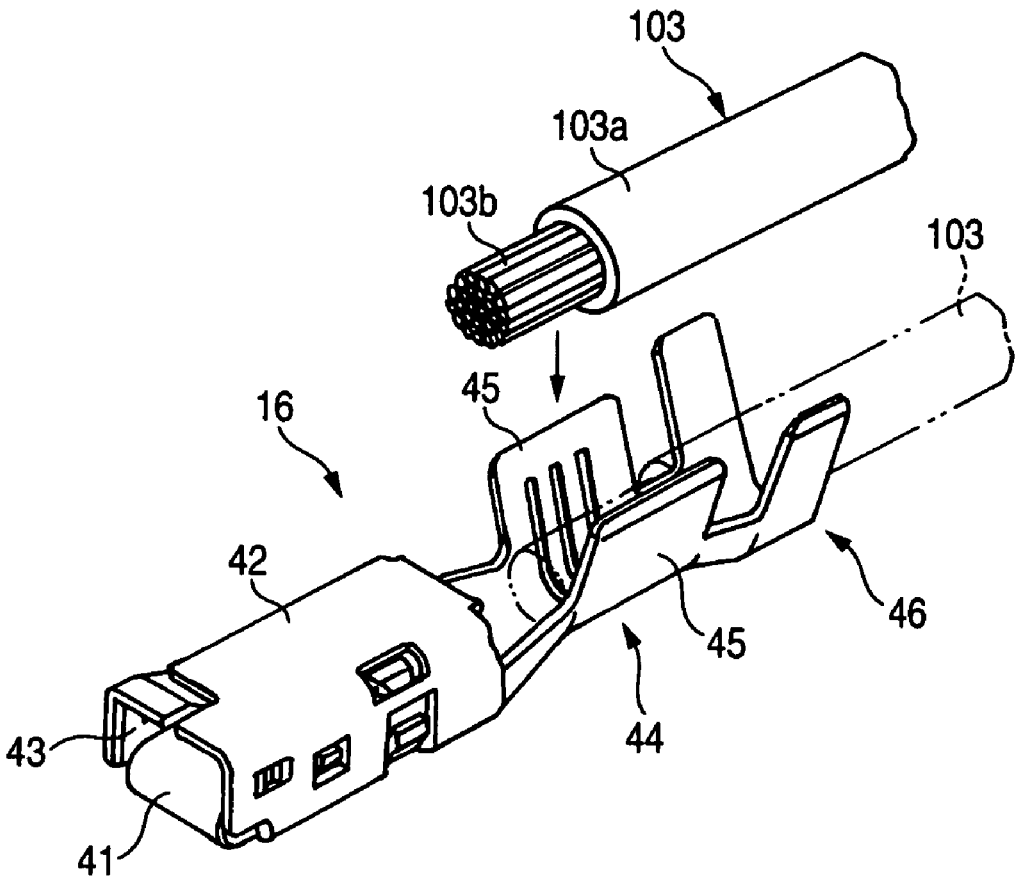
FIG. 5 is a perspective view showing a crimping terminal.

On the other hand, as shown in FIG. 5, the crimping terminal 16 is also a terminal formed by press-forming a metal sheet. The crimping terminal 16 includes a connecting portion 41 elastically coming into contact with the male terminal 31 of the opponent connector, protected by the outer plate 42, an electric wire connecting section 44 composed of two crimping member 45 opposed to each other, and an electric wire fixing portion 46 for fixing the electric wire 103 arranged on the rear end side of the electric wire connecting portion 44. The male terminal 31 is inserted into the insertion port 43 formed by the outer plate 42 and contacted with the connecting portion 41.

In the case where the electric wire 103 is connected with the crimping terminal 16, the sheath 103*a* is stripped off to expose the core wire 103*b*, and the core wire 103*b* is positioned between the crimping members 45, and crimping is conducted on the crimping members 45 in such a manner that the crimping members 45 are laid down inside. As a result, the electric wire 103 and the crimping terminal 16 are connected being electrically communicated with each other.

Examples of the electric wire connected with the crimping terminal 16 are: a revolving wire, which is laid between a pair of connectors 1, 1 directed in the same direction along the longitudinal direction of the wire harness 100, flexible electric wire, thick electric wire, twist electric wire and shielded electric wire.

In this case, the flexible wire is defined as an electric wire having core wires, the diameters of which are less or equal to 0.3 mm, the number of which is not less than 8, which are laid in the periphery of a door of a vehicle.

The thick electric wire is an electric wire having core wires, the diameters of which are not less than 0.5 mm, the number of which is not less than 17, in which a relatively high intensity of electric current flows.

The twist wire is an electric wire, the core wire of which are covered with a metallic braid, which is provided on the sheath layer, via an insulating layer. The twist wire is mainly used for a signal conductor.

Next, a method of manufacturing the wire harness 100 according to the first embodiment will be explained below.

Figure 6:
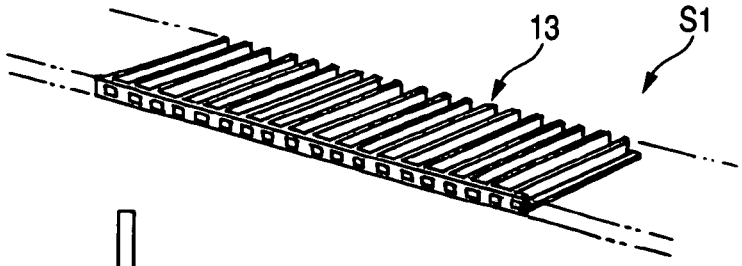
FIG. 6 is a perspective schematic illustration showing a step relating to the pressure-connecting terminal of the first embodiment.
Figure 6:
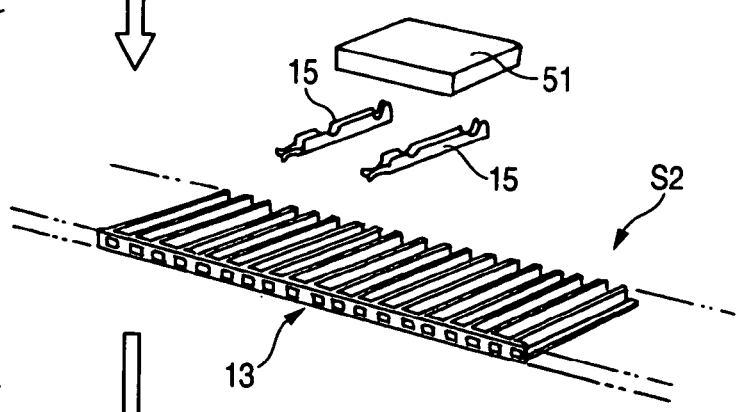
Figure 6:
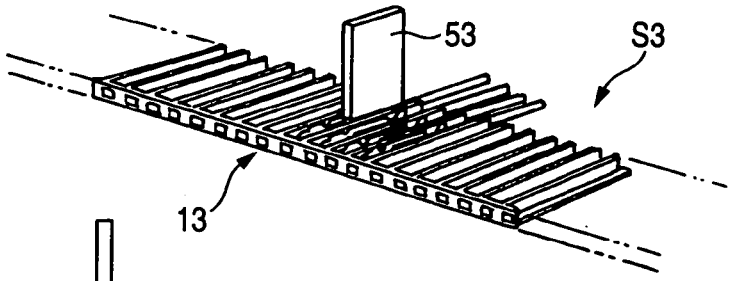
Figure 6:
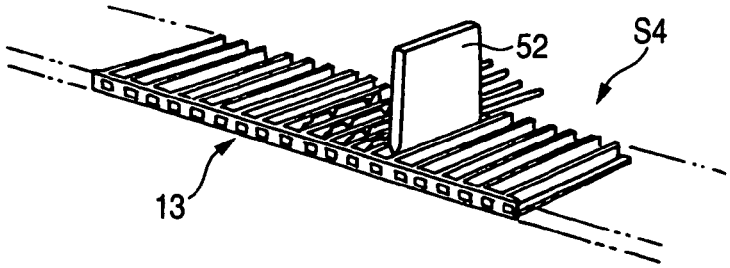

First, as shown in FIG. 6(A), the material insulating housing 13, for example, the number of the accommodating portions of which is 50, is put on a manufacturing apparatus not shown in the drawing (the first step S1).

Next, as shown in FIG. 6(B), as a pressure-connecting terminal inserting step in which the pressure-connecting terminals 15 are set between the partition walls 12, the pressure-connecting terminals 15 are inserted into the terminal accommodating portions 17, the inserting positions of which are previously set, by the terminal inserting machine 51 (the second step S2).

Next, as shown in FIG. 6(C), as a pressure-connecting step in which the electric wires 103 are connected with the pressure-connecting terminals 15, the electric wires 103 are pressure-connected with the pressure-connecting terminals 15 by the electric wire pressure-connecting machine 53 (the third step S3).

Next, as shown in FIG. 6(D), as a cutting step in which the material insulating housing 13 is cut by a predetermined length to obtain the insulating housing 3 of the predetermined length, the material insulating housing 13, the length of which corresponds to, for example, 20 accommodating portions in 50 accommodating portions, is cut off by the insulating housing cutter 52 (the fourth step S4).

Next, as a crimping step in which the crimping terminal 16 is arranged between the partition walls 12 after the electric wire 103 is connected with each crimping terminal 16, the crimping terminal 16, with which the electric wire 103 is previously by crimping, is inserted into the terminal accommodating portion 16 (the fifth step S5).

Figure 7:
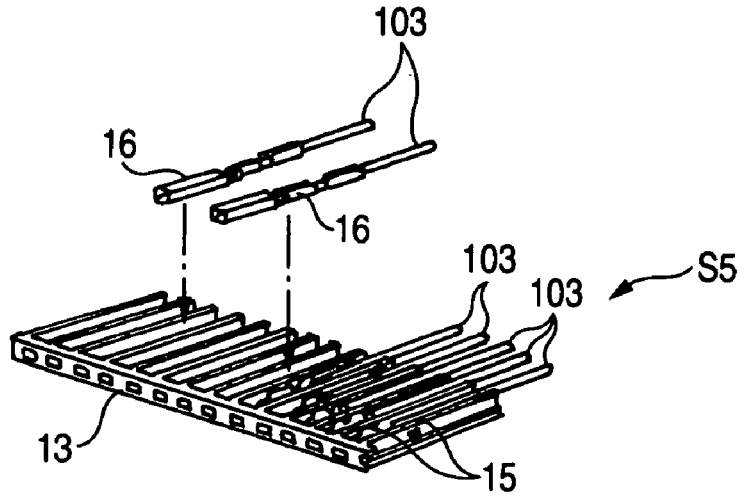
FIG. 7 is a perspective schematic illustration showing a step relating to the crimping terminal of the first embodiment.
Figure 7:
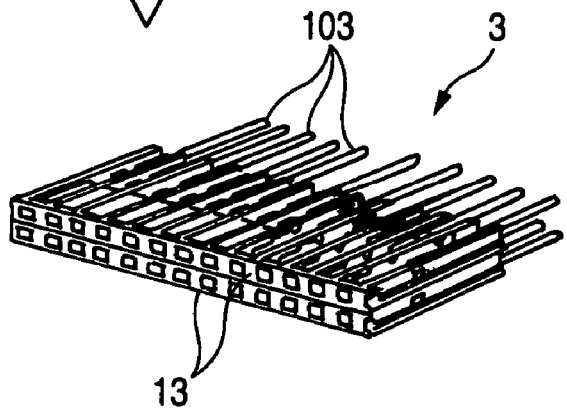

After the insulating housings 3 are put on each other as shown in FIG. 7(B), the cover member 2 shown in FIG. 1 is made to hold the insulating housings 3 to obtain the connector 1.

When the above steps are repeatedly conducted, a large number of electric wires 103 are connected with a plurality of connectors 1 to obtain the wire harness 100.

According to the above constitution, the wire harness 100 having the connector 1 is manufactured by the method including: a pressure-connecting terminal inserting step in which the pressure-connecting terminal is inserted into the material insulating housing 13; a pressure-connecting step; a cutting step in which the insulating housing 3 is obtained from the material insulating housing 13; and crimping step relating to the crimping terminal with respect to the insulating housing 3, wherein the cover member 2 is made to hold the insulating housing 3 via the above steps.

According to the method of manufacturing this wire harness 100, the step in which the pressure-connecting terminal 15 is inserted into the material insulating housing 13 and connected to the electric wire 103 with pressure and the step relating to the crimping terminal 16 are separate from each other. Therefore, even when the pressure-connecting terminals 15 and the crimping terminals 16 are arranged being mixed with each other in the connector 1, no problems are caused in automatizing the assembling step of assembling the pressure-connecting terminals 15 and the crimping terminals 16 to the connector 1. Due to the foregoing, a ratio of automatization can be enhanced and the cost of manufacturing the wire harness can be reduced.

According to the first embodiment described above, after the completion of the step in which the pressure-connecting terminals 15 are inserted into the material insulating housing 13 and then the electric wires 103 are pressure-connected with the pressure-connecting terminals 15, the cutting step is conducted. In other words, until the electric wires 103 are pressure-connected with the pressure-connecting terminals 15, the material insulating housings 13 of the same length can be conveyed on the conveyance line. Therefore, a pitch of conveyance of the conveyance line can be set at a constant value, so that the automatization can be facilitated.

According to the first embodiment described above, since the pressure-connecting terminal 15 is accommodated in the terminal accommodating portion 17 of the insulating housing 3, a pair of elastic pieces composing the connecting portion 32 of the pressure-connecting terminal 15 can be protected. Consequently, according to this first embodiment, it becomes unnecessary to provide a box-shaped protecting portion for protecting the pair of elastic pieces composing the connecting portion 32 of the pressure-connecting terminal 15. Due to the foregoing, the structure of the pressure-connecting terminal 15 can be simplified and the cost of manufacturing the wire harness 100 can be further reduced.

Next, the second embodiment of the present invention will be explained below.

In this connection, in the second embodiment shown below, the wire harness 100 to be manufactured is the same as the wire harness 100 of the first embodiment described before. Different points of the second embodiment from the first embodiment are the method of manufacturing the wire harness 100, especially, the order of the steps relating to the pressure-connecting terminal. Therefore, only these points will be explained below, and illustrations and explanations of the steps relating to the crimping terminal will be omitted here.

Figure 8:
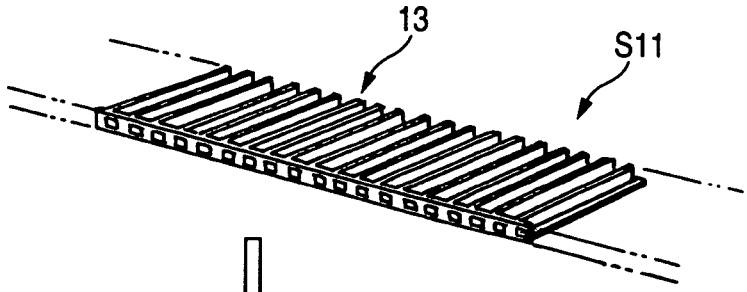
FIG. 8 is a perspective schematic illustration showing a step relating to the pressure-connecting terminal according to the second embodiment of the present invention.
Figure 8:
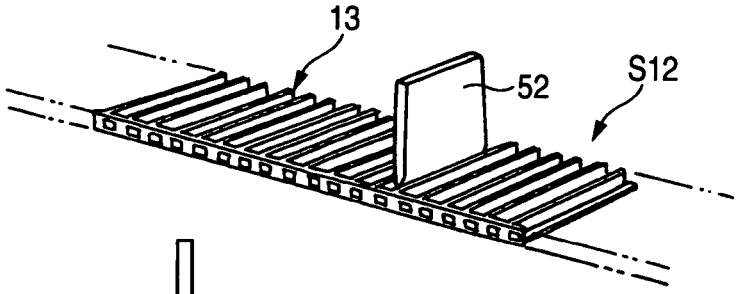
Figure 8:
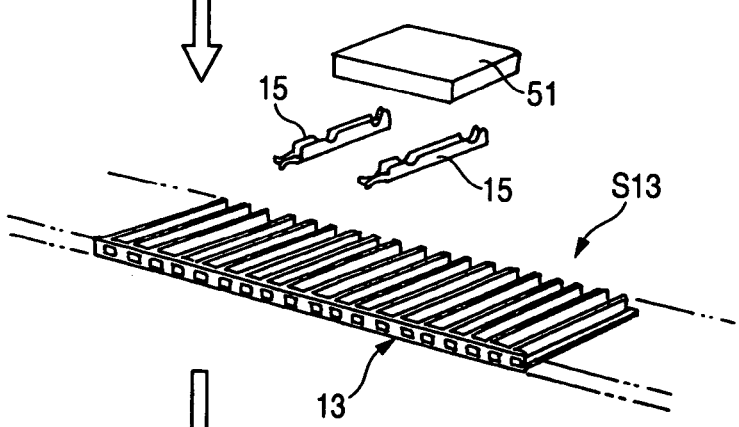
Figure 8:
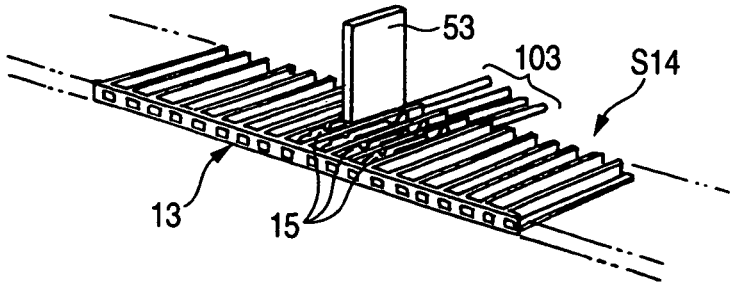

FIG. 8 is a view showing the step relating to the pressure-connecting terminal of the second embodiment.

In the step relating to the pressure-connecting terminal of the second embodiment, as shown in FIG. 8(A), the material insulating housing 13, for example, the number of the accommodating portions of which is 50, is put on a manufacturing apparatus not shown in the drawing (the first step S11).

Next, as shown in FIG. 8(B), as a cutting step in which the material insulating housing 13 is cut by a predetermined length to obtain the insulating housing 3 of the predetermined length, the material insulating housing 13, the length of which corresponds to, for example, 20 accommodating portions in 50 accommodating portions, is cut off by the insulating housing cutter 52 (the second step S12).

Next, as shown in FIG. 8(C), as a pressure-connecting terminal inserting step in which the pressure-connecting terminals 15 are set between the partition walls 12, the pressure-connecting terminals 15 are inserted into the terminal accommodating portions 17, the inserting positions of which are previously set, by the terminal inserting machine 51 (the third step S13).

Next, as shown in FIG. 8(D), as a pressure-connecting step in which the electric wires 103 are connected with the pressure-connecting terminals 15, the electric wires 103 are pressure-connected with the pressure-connecting terminals 15 by the electric wire pressure-connecting machine 53 (the fourth step S14).

After the completion of these steps, the process shifts to the step relating to the crimping terminal. In the same manner as that of the first embodiment, the cover member 2 is made to hold the insulating housings 3, 3 to compose the connector 1. In this way, the wire harness 100 can be obtained.

According to the above second embodiment, since the material insulating housing 13 is previously cut by a predetermined length in the step relating to the pressure-connecting terminal to obtain the insulating housing 3, there is no possibility that the electric wires 103 are erroneously cut off. Therefore, the percent defective in the manufacturing process can be reduced.

For example, the following operation can be conducted. A portion of the material insulating housing 13 corresponding to 20 accommodating portions is cut off from the material insulating housing 13 corresponding to 50 accommodating portions, and then the residual portion of the material insulating housing 13 corresponding to the 30 accommodating portions is immediately conveyed to the cutting step for cutting the portion of the material insulating housing 13 corresponding to 30 accommodating portions, and further the portion of the material insulating housing 13 corresponding to 20 accommodating portions is cut off.

Accordingly, it is possible to effectively utilize the material insulating housing 13 which is a part. Further, it is possible to enhance the working efficiency.

Next, the third embodiment of the present invention will be explained below.

In this connection, in the third embodiment shown below, the wire harness 100 to be manufactured is the same as the wire harness 100 of the first and the second embodiment described before. Different points of the third embodiment from the first and the second embodiment are the method of manufacturing the wire harness 100, especially, the order of the steps relating to the pressure-connecting terminal. Therefore, only these points will be explained below, and illustrations and explanations of the steps relating to the crimping terminal will be omitted here.

Figure 9:
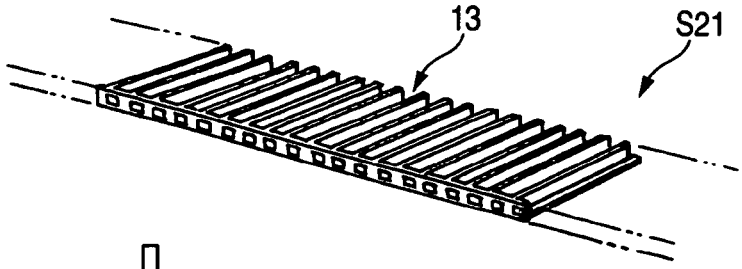
FIG. 9 is a perspective schematic illustration showing a step relating to the pressure-connecting terminal according to the third embodiment of the present invention.
Figure 9:
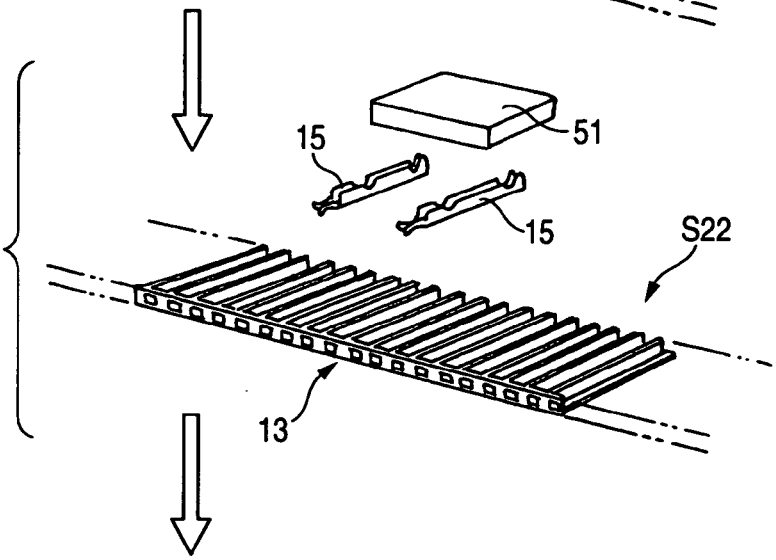
Figure 9:
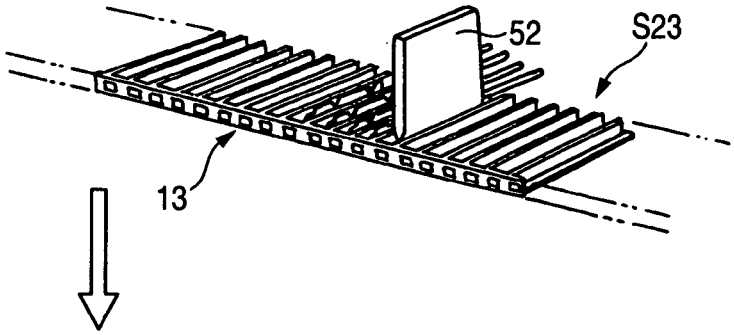
Figure 9:
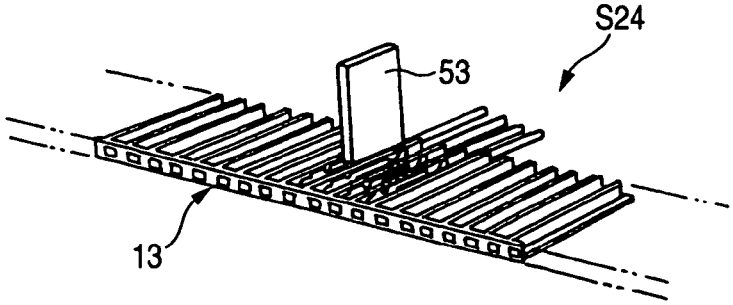

FIG. 9 is a view showing the step relating to the pressure-connecting terminal of the third embodiment.

In the step relating to the pressure-connecting terminal of the third embodiment, as shown in FIG. 9(A), the material insulating housing 13, for example, the number of the accommodating portions of which is 50, is put on a manufacturing apparatus not shown in the drawing (the first step S21).

Next, as shown in FIG. 9(B), as a pressure-connecting terminal inserting step in which the pressure-connecting terminals 15 are set between the partition walls 12, the pressure-connecting terminals 15 are inserted into the terminal accommodating portions 17, the inserting positions of which are previously set, by the terminal inserting machine 51 (the second step S22).

Next, as shown in FIG. 9(C), as a cutting step in which the material insulating housing 13 is cut by a predetermined length to obtain the insulating housing 3 of the predetermined length, the material insulating housing 13, the length of which corresponds to, for example, 20 accommodating portions in 50 accommodating portions, is cut off by the insulating housing cutter 52 (the third step S23).

Next, as shown in FIG. 9(D), as a pressure-connecting step in which the electric wires 103 are connected with the pressure-connecting terminals 15, the electric wires 103 are pressure-connected with the pressure-connecting terminals 15 by the electric wire pressure-connecting machine 53 (the fourth step S24).

After the completion of these steps, the process shifts to the step relating to the crimping terminal. In the same manner as that of the first and the second embodiment, the cover member 2 is made to hold the insulating housings 3, 3 to compose the connector 1. In this way, the wire harness 100 can be obtained.

According to the third embodiment described above, the pressure-connecting terminals 15 can be inserted into the material insulating housing 13 having 50 accommodating portions. Therefore, the production efficiency can be enhanced. Further, when the material insulating housing 13 is cut to obtain the insulating housing 3, there is no possibility that the electric wires 103 are erroneously cut off. Due to the foregoing, prevention of erroneously cutting the electric wires 103 and effective utilization of the material insulating housing 13 can be made compatible at a high-order dimension.

Figure 10:
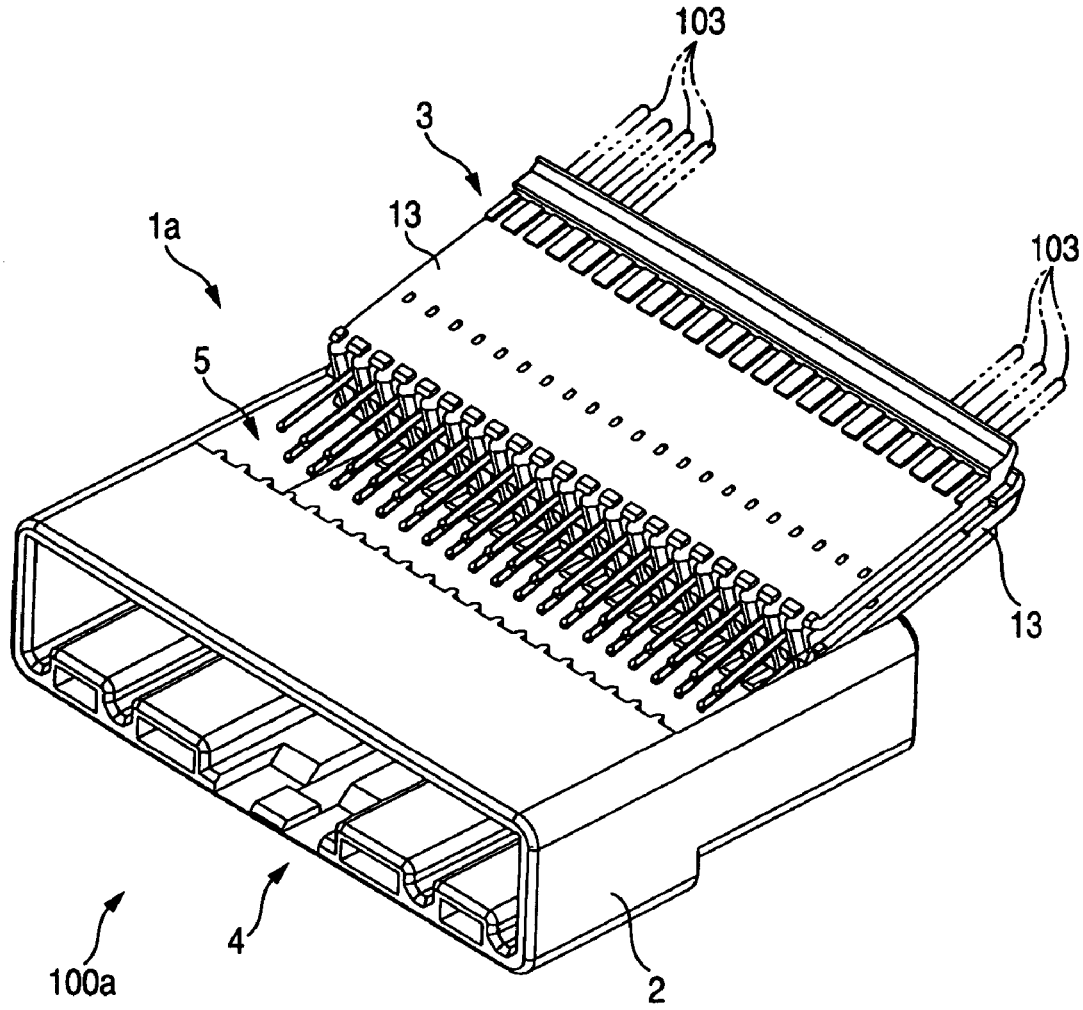
FIG. 10 is a perspective view showing a connector according to the fourth embodiment of the present invention.
Figure 11:
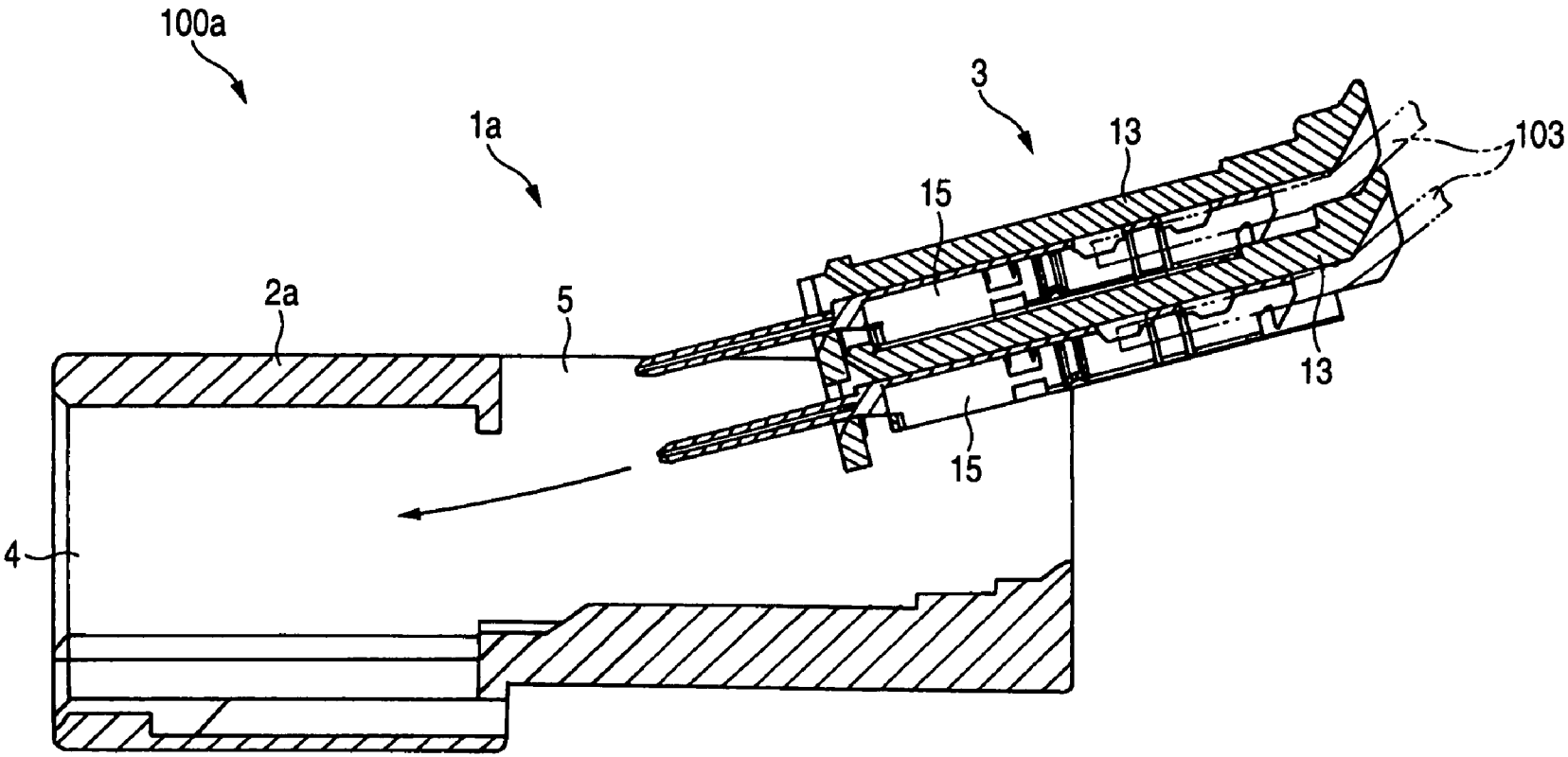
FIG. 11 is a sectional view showing a connector according to the fourth embodiment of the present invention.

FIGS. 10 and 11 are views showing a wire harness 100*a* according to the fourth embodiment of the present invention.

The cover member 2*a* composing the connector 1*a* of the wire harness 100*a* is made of synthetic resin and formed by integral molding. The connecting port 4 into which the opponent connector is inserted and connected is formed on the front end side, and the inserting port 5 into which the insulating housing 3 is inserted is formed on the rear end side.

According to the fourth embodiment described above, since the cover member 2*a* is formed into a substantially rectangular cylindrical shape, forward end portions of the male terminals accommodated in the insulating housing 3 can be covered with the cover member 2*a*.

Consequently, according to the fourth embodiment, the male terminals accommodated in the insulating housing 3 can be protected, so that the reliability of connection can be enhanced.

Figure 12:
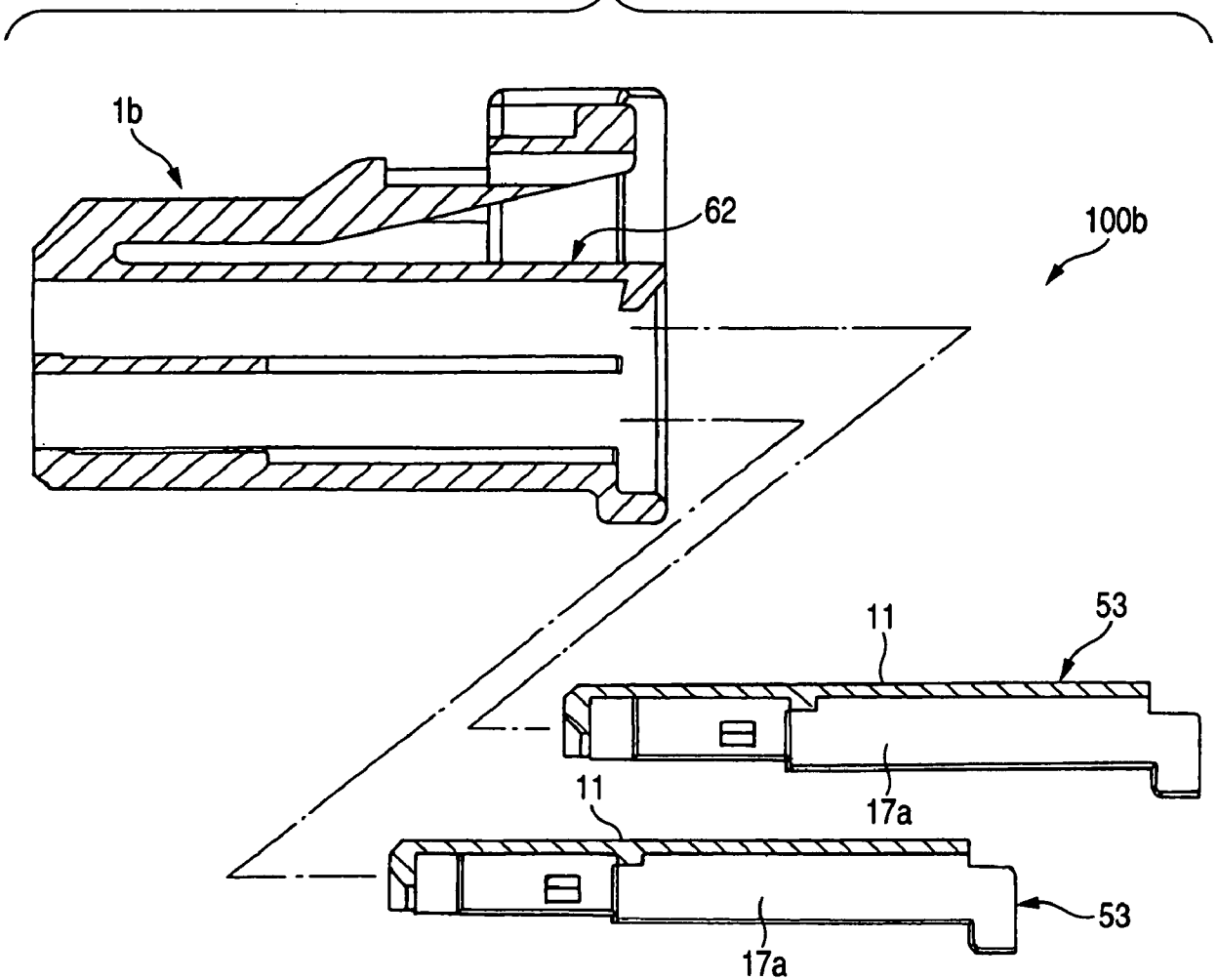
FIG. 12 is a sectional view showing a connector according to the fifth embodiment of the present invention.
Figure 13:
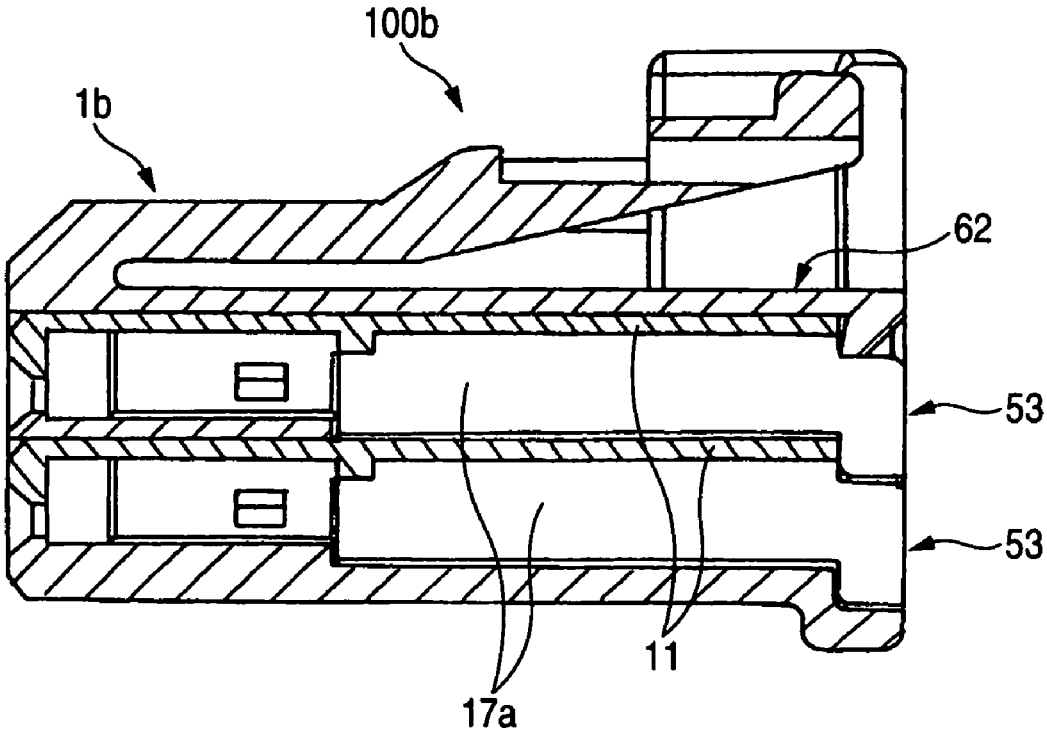
FIG. 13 is a sectional view showing a connector according to the fifth embodiment of the present invention.
Figure 14:
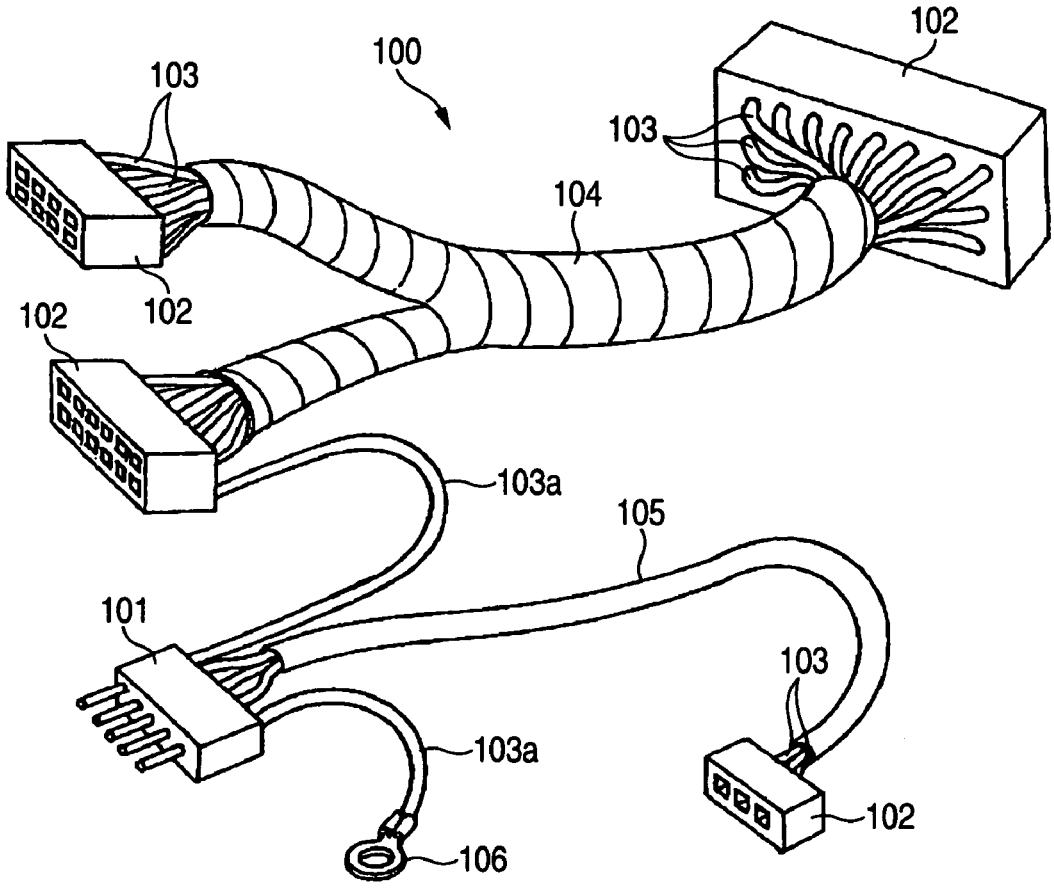
FIG. 14 is a perspective view showing an example of the conventional wire harness.

In FIGS. 12 and 13, the wire harness 100*b* according to the fifth embodiment of the present invention is shown. In this connection, the crimping terminals or the pressure-connecting terminals are omitted in FIGS. 12 and 13.

The connector 1*b* of this wire harness 100*b* is composed in the same manner as that of the connector 1 of the first embodiment as follows. Two insulating housings 53, in which a plurality of terminal accommodating portions 17*a* capable of accommodating the crimping terminals or the pressure-connecting terminals are arranged, are put on each other, and the crimping terminals and the pressure-connecting terminals are accommodated in these terminal accommodating portions 17*a* being mixed with each other.

The connector 1*b* of this embodiment is different from the connectors of the first to the fourth embodiment at the point that the connector 1*b* is provided with a cylindrical housing 62 which covers the peripheries of the insulating housings 53 which are put on each other.

According to the fifth embodiment composed as described above, in the same manner as that of the connector 1 of the first embodiment described before, the crimping terminals and the pressure-connecting terminals can be accommodated being mixed with each other. Further, the terminals can be more easily inserted into the terminal accommodating portions 17*a*, so that the assembling property of the connector 1*b* can be enhanced and the cost of manufacturing the wire harness 100*b* can be reduced.

In the case of the connector 1*b* of the fifth embodiment, when two insulating housings 53 are put on each other in the vertical direction and accommodated in the cylindrical housing 62, multiple stages of the terminal accommodating portions 17*a* are provided. However, it is possible to compose the connector by one stage of the insulating housing 53 or three or more stages of the insulating housings 53.

It should be noted that the present invention is not limited to the above specific embodiments. Appropriate modifications or improvements may be made by one skilled in the art. For example, an embodiment in which two insulating housings are put on each other is shown, however, the number of the insulating housings may be one, when necessary. In some cases, the number of the insulating housings may be three or more. The number of terminals and the number of housings are freely determined.

The present invention is explained above in detail referring to the specific embodiments. It is clear that various variations and modifications can be made by one skilled in the art without departing from the spirit and scope of the present invention.

The present application is based on Japanese Patent Application No. 2001-168474 filed on Jun. 4, 2001, and the contents of the application is taken in for the use of reference.

INDUSTRIAL APPLICABILITY

As explained above, according to the wire harness of the present invention, as described in claim 1, the pressure-connecting terminal inserting step in which the pressure-connecting terminals composing the connector are arranged between the partition walls formed in the insulating housing, the pressure-connecting step in which the electric wires are connected to the pressure-connecting terminals, the crimping step in which the crimping terminals are connected to the electric wires and arranged between the partition walls and the cutting step in which the insulating housing is cut, are conducted in an arbitrary order, and then the connector assembling step in which the insulating housing and the terminals are integrally accommodated in the cover member is conducted. In other words, the step relating to the pressure-connecting terminal capable of simply connecting the electric wires and the step relating to the crimping terminal are respectively provided as a different step. Therefore, the connection of at least the pressure-connecting terminal can be completely automatized, and the working property of manufacturing the wire harness can be enhanced and the cost of manufacturing the wire harness can be reduced.

As described in claim 2, the wire harness relating to the present invention is either a revolving wire, a flexible wire, a thick wire, a twist wire or a shielded wire laid between a pair of connectors directed in the same direction along the longitudinal direction of the wire harness.

On the other hand, according to the method of manufacturing the wire harness of the present invention, as described in claim 3, the pressure-connecting terminal inserting step is conducted in which the pressure-connecting terminals composing the connector are arranged between the partition walls of the insulating housing, and then the pressure-connecting step is conducted in which the electric wires are connected to the pressure-connecting terminals. After that, the cutting step is conducted in which the insulating housing is cut off by a predetermined length, and then the process shifts to the step relating to the crimping terminal. Therefore, concerning the insulating housing, the shape of which is the same as the initial shape, the insertion of the pressure-connecting terminals and the connection of the electric wires are successively conducted. Accordingly, it is possible to maintain the feeding speed of the insulating housing constant, and automatization of the assembling step can be facilitated and the manufacturing cost can be reduced.

According to the method of manufacturing a wire harness of the present invention, as described in claim 4, after the insulating housing is cut off, the pressure-connecting terminals are arranged between the partition walls in the insulating housing in the pressure-connecting terminal inserting step. Next, the pressure-connecting step is conducted in which the electric wires are connected to the pressure-connecting terminals with pressure. After the electric wires are connected to the pressure-connecting terminals, the process shifts to the step relating to the crimping terminals. Therefore, since the insulating housing is cut off in advance, there is no possibility that the electric wires are cut off, and the percent defective can be reduced in the manufacturing process.

According to the method of manufacturing a wire harness of the present invention, as described in claim 5, the pressure-connecting terminals are arranged between the partition walls formed in the insulating housing in the pressure-connecting terminal inserting step. Next, the cutting step is conducted in which the insulating housing is cut off by a predetermined length. After that, the pressure-connecting step is conducted in which the electric wires are connected to the pressure-connecting terminals, and then the process shifts to the step relating to the crimping terminals. Accordingly, the effect of reducing a possibility that the electric wires are cut off and the effect of utilizing the insulating housing can be made to be compatible with each other at a high-order dimension.

According to the method of manufacturing a wire harness of the present invention, as described in claim 6, since the protective portion for surrounding a pair of elastic pieces arranged in the pressure-connecting terminals is omitted, the structure of the pressure-connecting terminals can be simplified. Due to the foregoing, the cost of manufacturing the wire harness can be further reduced.

What is claimed is:

1. A wire harness comprising:

an insulating housing, having a substantially band-shaped board on which partition walls continuously formed in the width direction of the board, the partition walls arranged at regular intervals in the longitudinal direction of the board, the insulating housing capable of being cut by a predetermined length;

a cover member, capable of holding the insulating housing;

a plurality of pressure-connecting terminals and crimping terminals, respectively arranged along the partition walls; and a plurality of electric wires, respectively connected with the pressure-connecting terminals and crimping terminals, wherein the wire harness is formed by conducting the manufacturing steps including: a pressure-connecting terminal inserting step in which the pressure-connecting terminals are respectively arranged between the partition walls; a pressure-connecting step in which the electric wires are respectively connected with the pressure-connecting terminals; a crimping step in which the crimping terminals are respectively arranged between the partition walls after the electric wires are respectively connected with the crimping terminals; a cutting step in which the insulating housing is cut into a predetermined length; and a connector assembling step in which the insulating housing is held by the cover member, and the wire harness is formed by conducting the connector assembling step after the pressure-connecting terminal inserting step, the pressure-connecting step, the crimping step and the cutting step are conducted in an arbitrary order.

2. The wire harness as set of claim 1, wherein the electric wire connected with the crimping terminal is either a revolving wire, a flexible wire, a thick wire, a twist wire or a shielded wire laid between a pair of connectors directed in the longitudinal direction of the wire harness.

3. A method of manufacturing a wire harness including: a connector which has an insulating housing having a substantially band-shaped board on which partition walls continuously formed in the width direction of the board, the partition walls arranged at regular intervals in the longitudinal direction of the board, the insulating housing capable of being cut by a predetermined length, and the connector which has a cover member capable of holding the insulating housing: a plurality of pressure-connecting terminals and crimping terminals respectively arranged along the partition walls: and a plurality of electric wires respectively connected with the pressure-connecting terminals and crimping terminals, the method of manufacturing the wire harness comprising:

a pressure-connecting terminal inserting step in which the pressure-connecting terminals are respectively arranged between the partition walls;

a pressure-connecting step in which the electric wires are respectively connected with the pressure-connecting terminals;

a cutting step in which the insulating housing is cut into a predetermined length;

a crimping step in which the crimping terminals are respectively arranged between the partition walls after the electric wires are connected with the crimping terminals; and a connector assembling step in which the insulating housing is accommodated by the cover member, wherein the pressure-connecting terminal inserting step, the pressure-connecting step, the cutting step, the crimping step and the connector assembling step are conducted in the order.

4. A method of manufacturing a wire harness including: a connector which has an insulating housing having a substantially band-shaped board on which partition walls continuously formed in the width direction of the board, the partition walls arranged at regular intervals in the longitudinal direction of the board, the insulating housing capable of being cut by a predetermined length, and the connector which has a cover member capable of holding the insulating housing: a plurality of pressure-connecting terminals and crimping terminals respectively arranged along the partition walls: and a plurality of electric wires respectively connected with the pressure-connecting terminals and crimping terminals, the method of manufacturing the wire harness comprising:

a cutting step in which the insulating housing is cut into a predetermined length;

a pressure-connecting terminal inserting step in which the pressure-connecting terminals are respectively arranged between the partition walls;

a pressure-connecting step in which the electric wires are respectively connected with the pressure-connecting terminals;

a crimping step in which the crimping terminals are respectively arranged between the partition walls after the electric wires are respectively connected with the crimping terminals; and a connector assembling step in which the insulating housing is accommodated in the cover member, wherein the cutting step, the pressure connecting terminal inserting step, the pressure-connecting step, the crimping step and the connector assembling step are conducted in the order.

5. A method of manufacturing a wire harness including: a connector which has an insulating housing having a substantially band-shaped board on which partition walls continuously formed in the width direction of the board, the partition walls arranged at regular intervals in the longitudinal direction of the board, the insulating housing capable of being cut by a predetermined length, and the connector which has a cover member capable of holding the insulating housing: a plurality of pressure-connecting terminals and crimping terminals respectively arranged along the partition walls: and a plurality of electric wires respectively connected with the pressure-connecting terminals and crimping terminals, the method of manufacturing the wire harness comprising:

a pressure-connecting terminal inserting step in which the pressure-connecting terminals are respectively arranged between the partition walls;

a cutting step in which the insulating housing is cut into a predetermined length;

a pressure-connecting step in which the electric wires are respectively connected with the pressure-connecting terminals;

a crimping step in which the crimping terminals are respectively arranged between the partition walls after the electric wires are respectively connected with the crimping terminals; and a connector assembling step in which the insulating housing is accommodated in the cover member, wherein the pressure-connecting terminal inserting step, the cutting step, the pressure-connecting step, the crimping step and the connector assembling step are conducted in the order.

6. The method of manufacturing a wire harness as set forth in any one of claims 3 to 5, wherein the pressure-connecting terminal is a female pressure-connecting terminal having a pair of elastic pieces; and wherein a substantially box-shaped protective portion to surround each of the elastic pieces is omitted.

* * * * *